US010796845B2

(12) United States Patent
Zannol et al.

(10) Patent No.: US 10,796,845 B2
(45) Date of Patent: Oct. 6, 2020

(54) MAGNETIC SHUNT ASSEMBLY FOR MAGNETIC SHIELDING OF A POWER DEVICE

(71) Applicant: ABB Power Grids Switzerland AG, Baden (CH)

(72) Inventors: Roberto Zannol, Montegrotto Terme (IT); Gianluca Bustreo, Mirano (IT)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 15/952,643

(22) Filed: Apr. 13, 2018

(65) Prior Publication Data

US 2018/0233276 A1 Aug. 16, 2018

Related U.S. Application Data

(63) Continuation of application No. PCT/EP2015/073617, filed on Oct. 13, 2015.

(51) Int. Cl.

| | |
|---|---|
| ***H01F 27/02*** | (2006.01) |
| ***H01F 27/36*** | (2006.01) |
| ***H01F 41/00*** | (2006.01) |
| ***H01F 41/02*** | (2006.01) |
| *H01F 27/33* | (2006.01) |

(52) U.S. Cl.

CPC ..... *H01F 27/365* (2013.01); *H01F 27/02* (2013.01); *H01F 41/00* (2013.01); *H01F 41/0233* (2013.01); *H01F 27/33* (2013.01)

(58) Field of Classification Search

CPC ..... B32B 15/011; H01F 27/02; H01F 27/33; H01F 27/36; H01F 27/365; H01F 27/245; H01F 41/00; H01F 41/0233; H05K 9/0075

USPC ..... 174/520, 35; 336/178

See application file for complete search history.

(56) References Cited

U.S. PATENT DOCUMENTS 2,567,717 A * 9/1951 Lagerlof ..... H01F 38/08 336/20
3,014,189 A * 12/1961 MacKinnon ..... H01F 27/365 336/87
4,068,040 A * 1/1978 Yamada ..... G11B 5/7022 427/128
4,365,407 A * 12/1982 Zdaniewski ..... H02K 3/325 29/598

(Continued)

FOREIGN PATENT DOCUMENTS

DE 1763354 A1 11/1971
DE 3415785 A1 * 10/1984 ..... H01F 27/245

(Continued)

OTHER PUBLICATIONS

Nationalmaglab_tutorial on Magnegtic Shunt_pp. 1-6_Dec. 10, 2014.*

(Continued)

*Primary Examiner* — Timothy J Thompson
*Assistant Examiner* — Guillermo J Egoavil
(74) *Attorney, Agent, or Firm* — Sage Patent Group

(57) ABSTRACT

The present application relates to a magnetic shunt assembly for magnetic shielding of a power device, in one form for an electrical power transformer, including a plurality of joined ferromagnetic sheets and a plurality of bonding layers for bonding subsequent sheets of the plurality of ferromagnetic sheets to form an integral assembly.

12 Claims, 4 Drawing Sheets

(56) References Cited

U.S. PATENT DOCUMENTS 4,447,795 A * 5/1984 Sefko ..... H01F 27/245 336/178
5,045,637 A * 9/1991 Sato ..... B32B 15/011 174/391
5,139,857 A * 8/1992 Herndon ..... B32B 7/12 428/220
5,174,833 A * 12/1992 Tanaka ..... C21D 8/1283 148/113
2003/0020579 A1* 1/2003 Ngo ..... H01F 41/0226 336/5
2005/0073818 A1* 4/2005 Hirano ..... H01G 4/40 361/763
2007/0086127 A1* 4/2007 Huang ..... H01H 83/04 361/42
2010/0033187 A1* 2/2010 Reiderman ..... G01V 3/28 324/346
2010/0321143 A1* 12/2010 Satake ..... H01F 17/04 336/192
2012/0065073 A1* 3/2012 Maher ..... H01F 41/048 505/162
2012/0137511 A1* 6/2012 Flaherty ..... H05K 3/4691 29/825
2012/0156441 A1 6/2012 Gerster et al.

FOREIGN PATENT DOCUMENTS

DE 3415785 A1 10/1984
DE 102008048486 A1 4/2010
GB 1270804 4/1971
KR 101513052 B1 * 4/2015 ..... H01Q 1/24
WO 2014185267 A1 11/2014

OTHER PUBLICATIONS

European Patent Office, International Search Report & Written Opinion issued in corresponding Application No. PCT/EP2015/073617, dated Jun. 10, 2016, 12 pp.

* cited by examiner

MAGNETIC SHUNT ASSEMBLY FOR MAGNETIC SHIELDING OF A POWER DEVICE

BACKGROUND

Technical Field

The present invention relates to a magnetic shunt assembly for magnetic shielding of a power device, such as an electrical power transformer.

Description of the Related Art

Magnetic shielding is employed to protect a certain object that has a certain volume, such as for example a power device, in particular a power transformer, from magnetic fields such as e.g. stray magnetic fields, which induce power losses. A known solution for magnetic shielding employs so called magnetic shunts that comprise magnetically highly permeable materials. This solution is also referred to as magnetic shunting.

In large power devices such as power transformers, the existence of a stray magnetic flux is usually inevitable and cannot be entirely prevented just by a careful and thorough design of the power device itself. Having a certain level of stray magnetic fields in a power transformer leads to a certain level of corresponding eddy currents in the affected conductive bodies of the power transformer such as e.g. the transformer tank, the eddy currents being induced by the stray magnetic flux. The induced eddy currents reduce the efficiency of the power device and further contribute to a possible overheating of the power device, thereby at the same time increasing the risk of a local temperature rise. To avoid the penetration of stray magnetic fields into conductive bodies of a power device, the before-mentioned magnetic shunts can be used.

Magnetic shunts are magnetic screens that consist of magnetically highly permeable material. Usually, several standardized magnetic shunts are combined in a shunting arrangement system that is placed between the source of the stray field and the object to be shielded. For example, to protect a tank wall of a power transformer from a stray magnetic field, the magnetic shunts are typically arranged in a row and placed parallel to the tank wall.

Although the use of magnetic shunts is an effective way to decrease the additional losses caused by the stray magnetic flux, a drawback which limits their use is that their vibration increases the load noise. Hence, magnetic shunts cannot be profitably used in case of strict load noise requirements.

BRIEF SUMMARY OF THE INVENTION

The object of the present invention is therefore to provide a magnetic shunt assembly ensuring low noise emissions while maintaining an efficient load loss reduction.

This and other objects achieved by a magnetic shunt assembly in accordance with claim 1.

Dependent claims define possible advantageous embodiments of the invention.

BRIEF DESCRIPTION OF THE DRAWINGS

Further characteristics and advantages of the magnetic shunt assembly according to the invention will be more apparent from the following description of preferred embodiments given as a way of an example with reference to the enclosed drawings in which.

DETAILED DESCRIPTION

Figure 1:
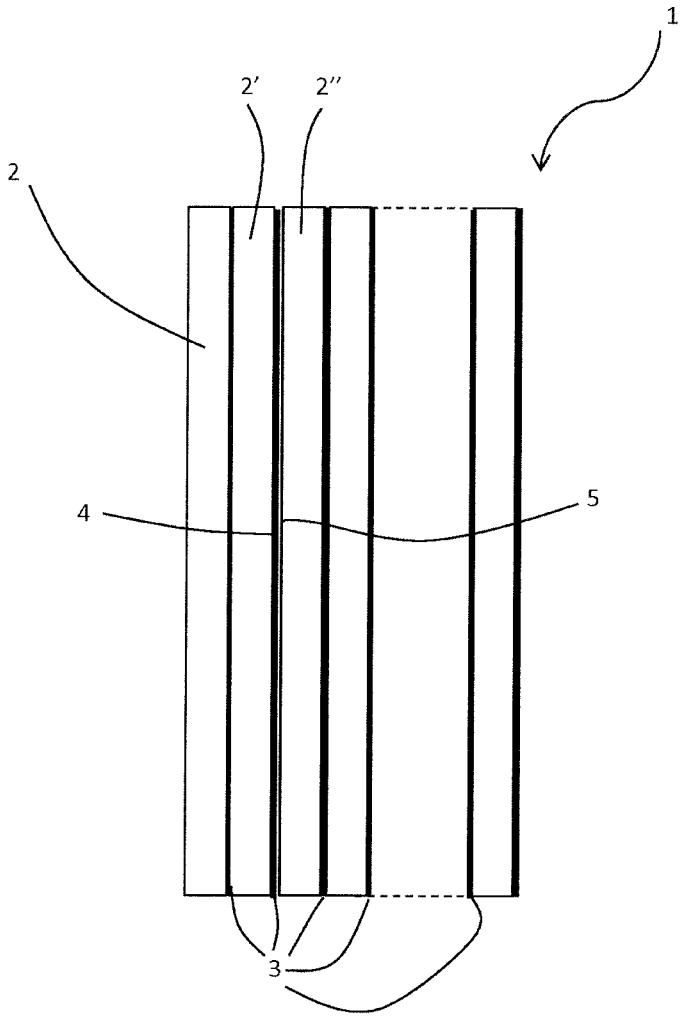
FIG. 1 shows a schematic lateral view of a magnetic shunt assembly according to a possible embodiment of the invention.

With reference to the annexed FIG. 1, a magnetic shunt assembly is indicated with reference number 1. The magnetic shunt assembly 1 is intended to be associated to a power device, in particular to an electrical power transformer, for magnetic shielding of the latter, as will be described later in more detail.

Figure 2:
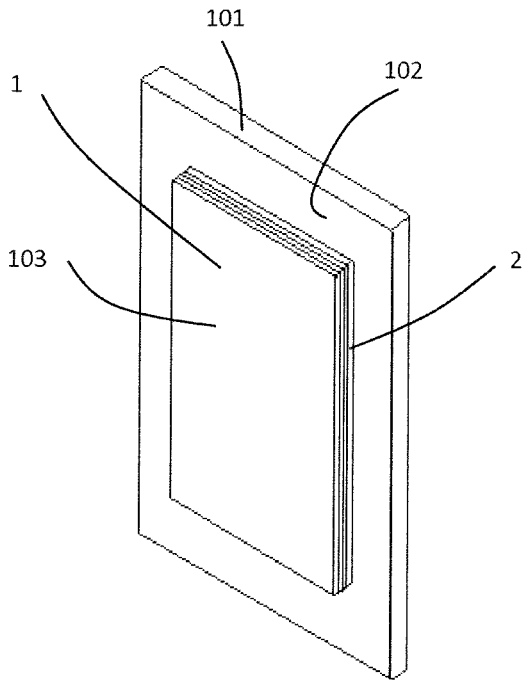
FIG. 2 shows a schematic perspective view of a magnetic shunt assembly coupled to a wall of a tank for a power device, such as a power transformer, according to a possible embodiment of the invention.
Figure 3:
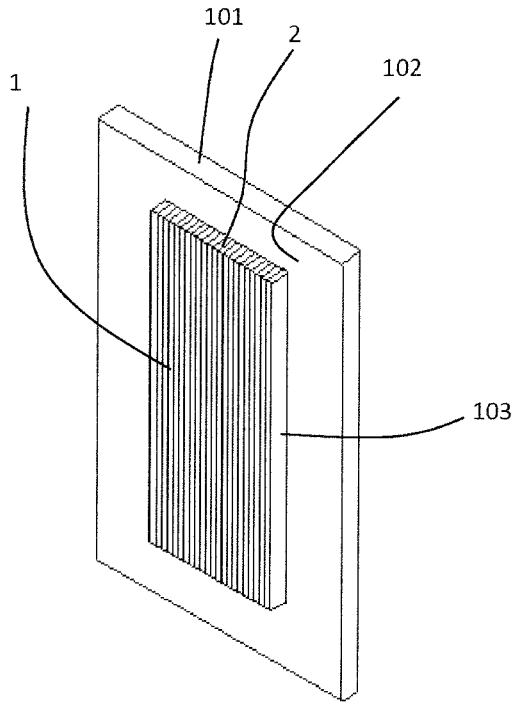
FIG. 3 shows a schematic perspective view of a magnetic shunt assembly coupled to a wall of a tank for a power device, such as a power transformer, according to a further possible embodiment of the invention.
Figure 4:
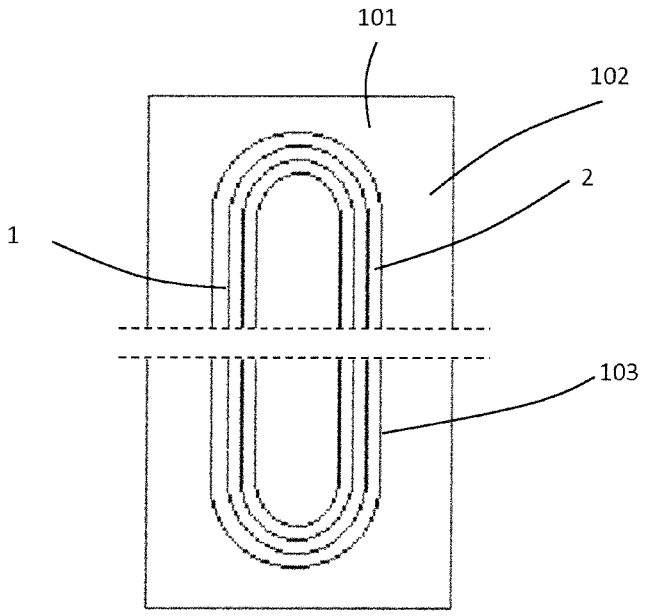
FIG. 4 shows a schematic front view of a magnetic shunt assembly according to a further possible embodiment of the invention.

The magnetic shunt assembly 1 comprises a plurality of sheets 2, made of ferromagnetic material, such as electrical steel. By way of example, the ferromagnetic material can be a grain oriented ferromagnetic material. Sheets 2 have preferably the same shape, for example rectangular shape, still more preferably in the form of a thin plate, and are joined together. According to the embodiment schematically shown in FIG. 2, sheets 2 can be in form of stacked thin plates. According to a further possible embodiment, as shown in FIG. 3, sheets 2 can be in form of thin stacked strips. According to a further possible embodiment (as schematically shown in FIG. 4), sheets 2 can be alternatively in the form of thin sheets wound in a spiral arrangement (so-called "wound shunts").

Turning back to FIG. 1, the magnetic shunt assembly 1 further comprises a plurality of bonding layers 3 which are respectively arranged between subsequent sheets of the plurality of sheets 2, so to bond them one to another. In other words, each ferromagnetic sheet is bonded to the adjacent ferromagnetic sheet by means of one of the bonding layers 3. In this manner, sheets 2 are joined integrally so to form an integral assembly. In particular, each sheet 2 has a first surface 4 and a second surface 5. Considering two subsequent sheets of the stack facing each other, the first surface 4 of the first sheet 2' faces the second surface 5 of the second sheet 2", and the bonding layer 3 is placed between the first surface 4 of the first sheet 2' and the second surface 5 of the second sheet 2". Bonding layers 3 can be differently configured and applied between the sheets 2.

According to a possible embodiment, each of the bonding layer 3 is obtained from a thermosetting resin, in particular from a liquid thermosetting resin, which is cured after the application on the sheets 2. For example, possible thermosetting resins are: DuPont™ Voltalex® 1175W or C.D. Wälzholz PE 75W, both based on a water soluble epoxy resin. These resins are particularly compatible with the mineral oil used in the electrical power transformers. Of course, other similar thermosetting resins not explicitly cited can be alternatively employed.

If the thermosetting resin is used and the sheets 2 are stacked, the stack forming the magnetic shunt assembly 1 can be obtained by a so-called back lack process, which is typically used for manufacturing stators of electric motors.

According to this kind of approach, the process for manufacturing the magnetic shunt assembly 1 comprises:

providing an uncoated strip made of the same material of the sheets 2 to be formed and having the same width;

coating the strip with the thermosetting resin, either on one or both surfaces thereof. Coating can be obtained by passing the sheet through rolls and releasing the resin. Preferably, the coating thickness is lower than 0.01 mm;

drying the thermosetting resin coating in a first furnace at a suitable temperature for a suitable time. The drying temperature and time depend on the type of thermosetting resin used. For example, if DuPont™ Voltalex® 1175W is used, it can be dried at about 300° C. for about 50 s.

stamping the so coated strip in a plurality of coated sheets having the same shape. This can be achieved for example by cutting or punching the coated strip;

stacking the coated sheets, for example by means of o shaped dye to keep the sheets in the correct relative positions;

hardening the thermosetting resin lying between subsequent stacked sheets in a second furnace, so to induce the crosslinking in the thermosetting resin. This latter step is performed at an appropriate temperature for an appropriate time, depending on the type of resin used, and eventually at an appropriate pressure. The hardening time can also depend on the size of the stacked sheets 2. For example, if DuPont™ Voltalex® 1175W is used, it can be hardened at about 200° C. at a pressure of about ⅙ $N/m^2$.

In alternative to the above described process, structural adhesives can be deployed for forming the bonding layers 3.

According to a possible embodiment, the bonding layers 3 are formed from an epoxy adhesive system comprising an epoxy adhesive and a curing agent. Such adhesive systems are based on the curing of the epoxy resin forming the epoxy adhesive which is activated by the curing agent (such adhesive systems are referred to as "two-component adhesives"). Such systems in general do not require any heat treatment for curing. However, due to the generally high viscosity, preferably a pressing step of the coating after its application is carried out while the resin is still uncured, still more preferably is maintained during the whole curing. In this manner it is possible to eject the surplus of adhesive and to rectify the thickness and planarity of the components. Advantageously, in order to reduce the viscosity, suitable solvents may be added to the adhesives.

The epoxy adhesive systems of the two-component type can be selected for example in the following group:

EPAN RE203

It is a is a two component, 100% solids epoxy coating.

Huntsmann Araldite® CY 236 (100% by weight)+Aradur® XB5979 (30% by weight)

It is a liquid, two-component trickle impregnation system, solventless, comprising a liquid, modified epoxy resin based on Bisphenol A (Araldite® CY 236) and a liquid, formulated Amine Hardener (Aradur® XB5979).

Huntsmann Araldite® CY 246 (100% by weight)+Hardener XB 5911 (32% by weight)

It is a liquid, two-component trickle impregnation system, solventless, comprising a liquid, unmodified epoxy resin based on Bisphenol A (Araldite® CY 246) and a liquid, formulated Amine Hardener (Aradur® XB5911).

Huntsmann Araldite® 2014-1 adhesive

It is a two-component, room temperature curing, thixotropic epoxy paste adhesive. In particular, it is a Biospherical A epoxy resin containing reactive diluent.

LOCTITE® EA 3421™ adhesive

It is a two-component epoxy adhesive which cures slowly at room temperature.

LOCTITE® EA 9497™ adhesive

It is a medium viscosity, two-component, room temperature curing epoxy adhesive.

MASTER BOND® polymer system EP30M4LV

It is a two-component, low viscosity room temperature curing epoxy system.

According to another possible embodiment, the bonding layers 3 are formed from an epoxy adhesive system comprising an epoxy adhesive curable by heat. These epoxy adhesive systems are commonly referred to as one-component adhesives. The epoxy adhesive systems of the one-component type can be selected for example in the following group:

Loctite® 4108 (also known as Macroplast® ESP4108): it is a one-component epoxy adhesive;

Loctite® 9514: it is a one-component epoxy adhesive.

According to another alternative embodiment, the bonding layers 3 are formed from an acrylic adhesive system comprising an acrylic adhesive and a curing agent. These acrylic systems are of the two-component type and in general requires a shorter curing time than epoxy adhesives. An optional thermal treatment is possible to shorten the curing time. In general, the mechanical properties are lower than those of the epoxy adhesives. However, in general they have a lower viscosity, which results in an easier application of the adhesive. Moreover, they are in general lower cost.

The acrylic adhesive and the curing agent can be either pre-mixed before being applied on opposite surfaces of subsequent sheets to be bonded, or, alternatively, can be respectively applied on opposite surfaces of subsequent sheets and mixed upon joining the sheets.

The acrylic adhesive systems can be selected for example in the following group:

HUNTSMAN Araldite® 2021

It is a two-component, room temperature curing, methacrylate adhesive system.

LOCTITE® AA 334™ adhesive

It is a two-step acrylic, one-pa dual-cure thixotropic magnet bonding adhesive.

In accordance with another aspect of the present invention, a tank for a power device, for example for a power transformer, is provided with one or more of magnetic shunt assemblies according to the invention.

Figure 5:
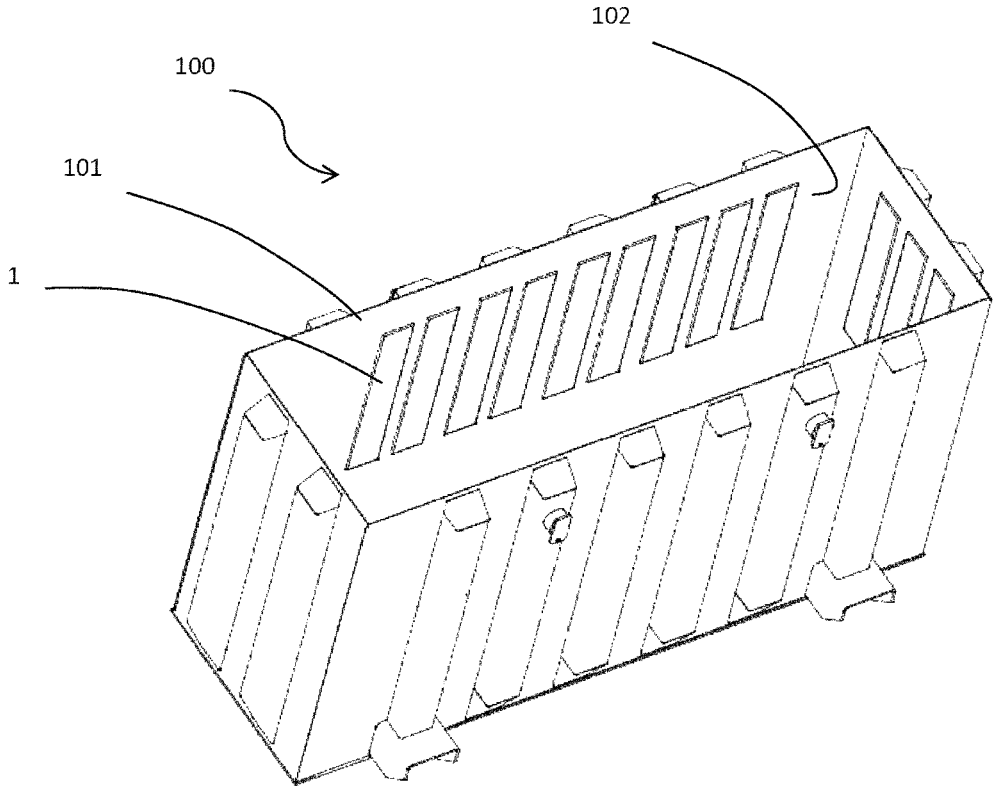
FIG. 5 shows a schematic perspective view of a tank for a power device, such as a power transformer, provided with a plurality of magnetic shunt assemblies according to a possible embodiment of the invention.

With reference to FIG. 5, the tank is indicated with reference number 100. Tank 100 comprises walls 101 delimiting the tank itself, which can be filled with a suitable refrigerant, such as an oil. Each wall 101 comprises an internal surface 102, where one or more magnetic shunt assemblies 1 are arranged. According to the embodiment shown in FIG. 2, sheets 2 of the magnetic shunt assembly 1 are in form of stacked plates whose main surfaces 103 are arranged parallel to the wall 101 internal surface 102. According to the embodiment shown in FIG. 3, sheets 2 of the magnetic shunt assembly 1 are in form of stacked thin strips whose main surfaces 103 are arranged perpendicular to the wall 101 internal surface 102, vertically oriented (wherein "vertically" is referred to the normal conditions of use of the tank). According to the embodiment shown in FIG. 4, sheets 2 of the magnetic shunt assembly 1 are in form of strips wound in a spiral arrangement whose main surfaces 103 are arranged perpendicular to the wall 101 internal surface 102.

Figure 6:
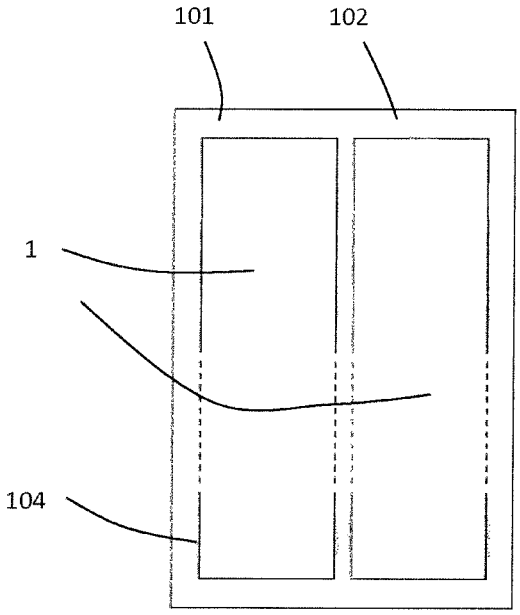
FIG. 6 shows a schematic side view of a plurality of magnetic shunt assemblies coupled to a tank wall according to a possible embodiment.

The coupling of the magnetic shunt assemblies 1 with the internal surfaces 102 of the tank walls 101 can be obtained in several different manners. According to a possible embodiment, the magnetic shunt assemblies 1 are coupled with the internal surfaces 102 of the tank walls 101 by welding. With reference for example to FIG. 6, the shunt assemblies 1 are welded to the internal surfaces 102 of the tank walls 101 in correspondence of one or more weld zones 104.

Figure 7:
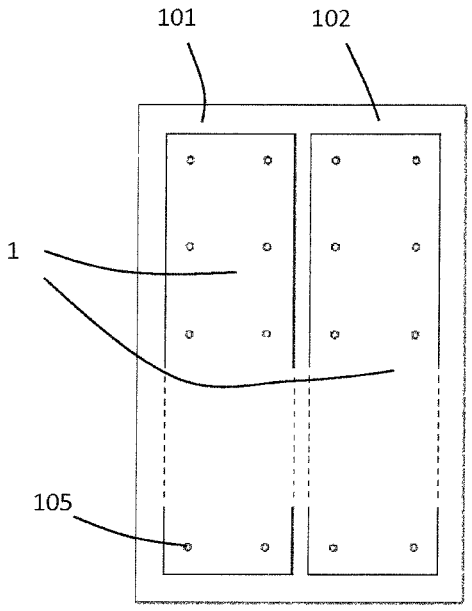
FIG. 7 shows a schematic side view of a plurality of magnetic shunt assemblies coupled to a tank wall according to a further possible embodiment.

According to a further possible embodiment, the magnetic shunt assemblies 1 are coupled with the internal surfaces 102 of the tank walls 101 by bolting. With reference for example to FIG. 7, the shunt assemblies 1 are bolted to the internal surfaces 102 of the tank walls 101 through one or more bolts 105.

Figure 8:
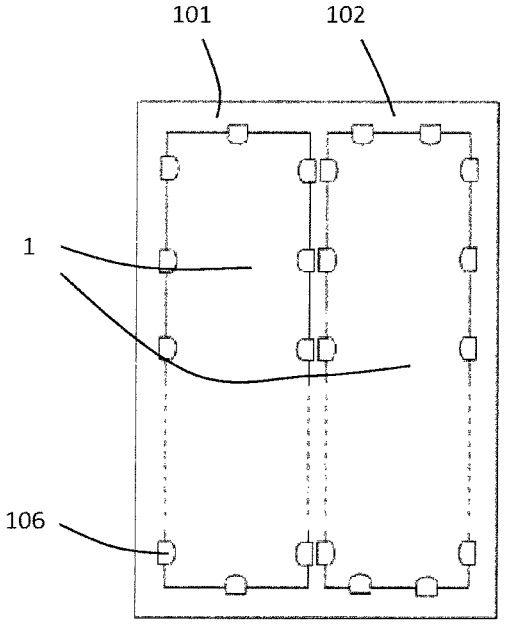
FIG. 8 shows a schematic side view of a plurality of magnetic shunt assemblies coupled to a tank wall according to a further possible embodiment.

According to a further possible embodiment, the magnetic shunt assemblies 1 are coupled with the internal surfaces 102 of the tank walls 101 by mechanical coupling means of different type. With reference for example to FIG. 8, the shunt assemblies 1 are coupled to the internal surfaces 102 of the tank walls 101 through one or more L-shaped supports 106, connected, preferably welded, to the internal surfaces 102 of the tank walls 101 and then bended so to laterally envelop the magnetic shunt assemblies 1.

Figure 9:
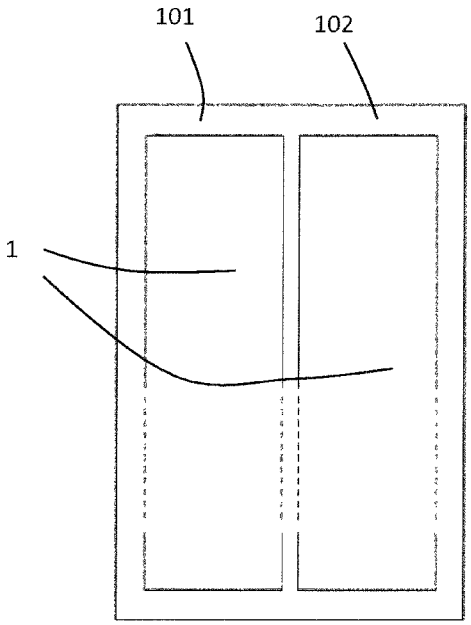
FIG. 9 shows a schematic side view of a plurality of magnetic shunt assemblies coupled to a tank wall according to a further possible embodiment.

According to a further possible embodiment (see for example FIG. 9), the magnetic shunt assemblies 1 are coupled with the internal surfaces 102 of the tank walls 101 by gluing.

The magnetic shunt assembly according to the invention, while maintaining a proper magnetic shielding when associated to a power device, ensures lower noise emissions than standard magnetic shunts since the ferromagnetic sheets are integral due the presence of the bonding layers. Hence, magnetic shunt assemblies according to the invention can be used in case of strict load noise requirement, where standard magnetic shunts generate unacceptable vibration noise.

To the above-mentioned embodiments of the magnetic shunt assembly according to the invention, the skilled person, in order to meet specific current needs, can make several additions, modifications, or substitutions of elements with other operatively equivalent elements, without however departing from the scope of the appended claims.

The invention claimed is:

1. A magnetic shunt assembly for magnetic shielding of a power device, comprising:

a plurality of joined ferromagnetic sheets in the form of strips wound in a spiral arrangement, each of the plurality of joined ferromagnetic sheets having a same width and each made from a same grain-oriented ferromagnetic material, and a plurality of bonding layers for bonding subsequent sheets of said plurality of ferromagnetic sheets to form an integral assembly, wherein each of the plurality of ferromagnetic sheets is bonded to an adjacent one of the plurality of ferromagnetic sheets via a respective one of the plurality of bonding layers, wherein the ferromagnetic sheets and the bonding layers are aligned, said bonding layers being one of:

obtained from a thermosetting resin;

formed from an adhesive system comprising an epoxy adhesive and a curing agent;

formed from an adhesive system comprising an epoxy adhesive curable by heat;

formed from an adhesive system comprising an acrylic adhesive and a curing agent;

wherein the plurality of joined ferromagnetic sheets form outermost layers of the magnetic shunt assembly; and means for coupling the magnetic shunt assembly externally of the power device.

2. The magnetic shunt assembly according to claim 1, wherein said ferromagnetic sheets are in the form of stacked plates or strips.

3. A magnetic shunt assembly for magnetic shielding of a power device, comprising:

a plurality of joined ferromagnetic sheets each having a same width and each made from a same grain-oriented ferromagnetic material, and a plurality of bonding layers for bonding subsequent sheets of said plurality of ferromagnetic sheets to form an integral assembly, wherein each of the plurality of ferromagnetic sheets is bonded to an adjacent one of the plurality of ferromagnetic sheets via a respective one of the plurality of bonding layers, said bonding layers being one of:

obtained from a thermosetting resin:

formed from an adhesive system comprising an epoxy adhesive and a curing agent;

formed from an adhesive system comprising an epoxy adhesive curable by heat;

formed from an adhesive system comprising an acrylic adhesive and a curing agent;

wherein the plurality of joined ferromagnetic sheets form outermost layers of the magnetic shunt assembly;

wherein said ferromagnetic sheets are in the form of strips wound in a spiral arrangement; and means for coupling the magnetic shunt assembly externally of the power device.

4. The magnetic shunt assembly according to claim 1, wherein said ferromagnetic sheets are electrical steel sheets.

5. The magnetic shunt assembly according to claim 1, wherein the bonding layers are formed from the adhesive system comprising the acrylic adhesive and the curing agent and wherein the acrylic adhesive and the curing agent are pre-mixed before being applied on opposite surfaces of subsequent sheets.

6. The magnetic shunt assembly according to claim 1, wherein the bonding layers are formed from the adhesive system comprising the acrylic adhesive and the curing agent and wherein the acrylic adhesive and the curing agent are respectively applied on opposite surfaces of subsequent sheets and mixed upon joining said subsequent sheets.

7. The magnetic shunt assembly according to claim 2, wherein said ferromagnetic sheets are grain oriented ferromagnetic sheets; and wherein said ferromagnetic sheets are electrical steel sheets.

8. The magnetic shunt assembly according to claim 3, wherein said ferromagnetic sheets are grain oriented ferromagnetic sheets; and wherein said ferromagnetic sheets are electrical steel sheets.

9. The magnetic shunt assembly according to claim 7, wherein said bonding layers are formed from the adhesive system comprising the epoxy adhesive and the curing agent.

10. The magnetic shunt assembly according to claim 8, wherein said bonding layers are formed from the adhesive system comprising the epoxy adhesive and the curing agent.

11. The magnetic shunt assembly according to claim 7, wherein said bonding layers are formed from the adhesive system comprising the-epoxy adhesive curable by heat.

12. The magnetic shunt assembly according to claim 8, wherein said bonding layers are formed from the adhesive system comprising the epoxy adhesive curable by heat.

* * * * *